US008147940B2

(12) United States Patent
Lee

(10) Patent No.: US 8,147,940 B2
(45) Date of Patent: Apr. 3, 2012

(54) PIECE OF CLOTH AND CLOTH PRODUCT CONSISTING OF A LARGE NUMBER OF PIECES OF CLOTH

(75) Inventor: Jungeun Lee, London (GB)

(73) Assignee: Builmatel Co., Ltd., Tokyo (JP)

( * ) Notice: Subject to any disclaimer, the term of this patent is extended or adjusted under 35 U.S.C. 154(b) by 0 days.

(21) Appl. No.: 13/138,383

(22) PCT Filed: Feb. 15, 2010

(86) PCT No.: PCT/JP2010/052232

§ 371 (c)(1),
(2), (4) Date: Aug. 8, 2011

(87) PCT Pub. No.: WO2010/095605

PCT Pub. Date: Aug. 26, 2010

(65) Prior Publication Data

US 2011/0293875 A1 Dec. 1, 2011

(30) Foreign Application Priority Data

Feb. 19, 2009 (JP) ..... 2009-037029
Nov. 6, 2009 (JP) ..... 2009-254507

(51) Int. Cl.
*B32B 3/10* (2006.01)

(52) U.S. Cl. ..... 428/52; 428/33; 428/53

(58) Field of Classification Search ..... 428/33, 428/52, 53; 2/243.1; 446/124, 125
See application file for complete search history.

(56) References Cited

U.S. PATENT DOCUMENTS 5,592,691 A 1/1997 Ronald

FOREIGN PATENT DOCUMENTS

JP S55-57795 4/1980
JP U S60-117496 8/1985

(Continued)

OTHER PUBLICATIONS

English translation of Abstract for U3114437.

(Continued)

*Primary Examiner* — Alexander Thomas
(74) *Attorney, Agent, or Firm* — Manabu Kanesaka

(57) ABSTRACT

Provided is a piece of cloth, wherein clothing composed of a soft and lightweight material can be constituted of flat small pieces. A piece of cloth consists of a hexagonal central part, and first and second peripheral edge parts located alternately at the peripheral edges of the central part. The first and second peripheral edge parts share one side of the hexagons, a first cut having a length shorter than the length of the side but longer than a quarter thereof is made in the border line of the first peripheral edge part and the central part, and second cuts having a length equal to or slightly longer than one half of [(the length of the side)−(the length of the first cut)] are made on the border line of the second peripheral edge part and the central part from the opposite ends of the side.

7 Claims, 6 Drawing Sheets

FOREIGN PATENT DOCUMENTS

| | | |
|---|---|---|
| JP | S61-125599 | 6/1986 |
| JP | S62-9638 | 1/1987 |
| JP | U S62-009638 | 1/1987 |
| JP | U3108027 | 1/2005 |
| JP | U 3108027 | 1/2005 |
| JP | U 3114437 | 8/2005 |
| JP | U3114437 | 8/2005 |
| JP | 2006-337411 | 12/2006 |
| JP | 2006-343091 | 12/2006 |
| JP | U 3136547 | 10/2007 |
| JP | U3136547 | 10/2007 |

OTHER PUBLICATIONS

English translation of Abstract for U3136547.
English translation of Abstract for U3108027.
English translation of Claims for S55-57795.
English translation of Claim for S62-9638.
English translation of Abstract from JPO for 2006-337411.

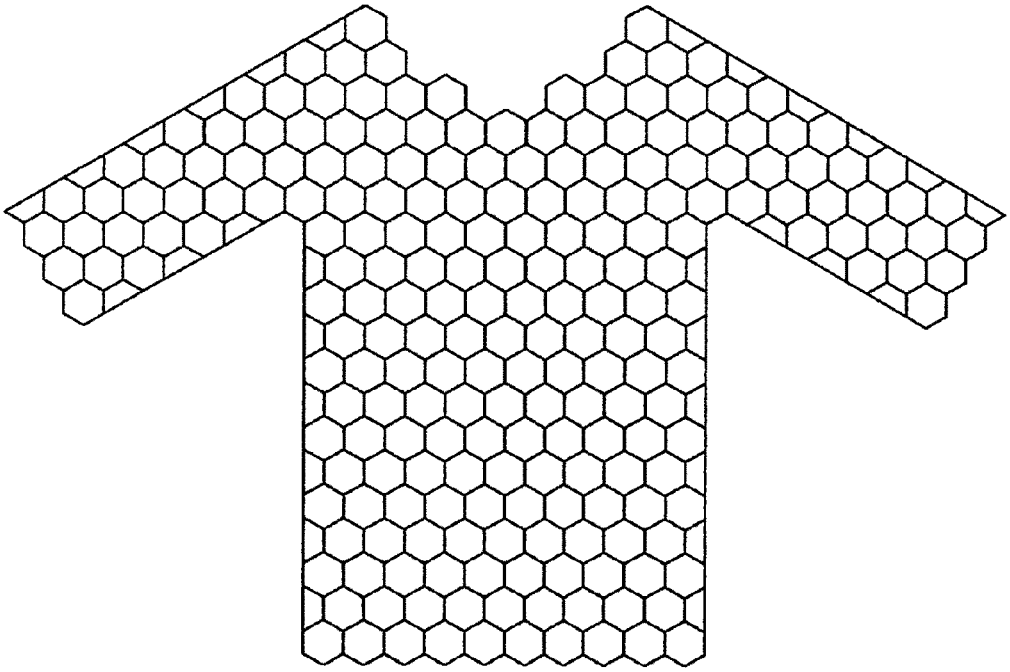
Fig. 7
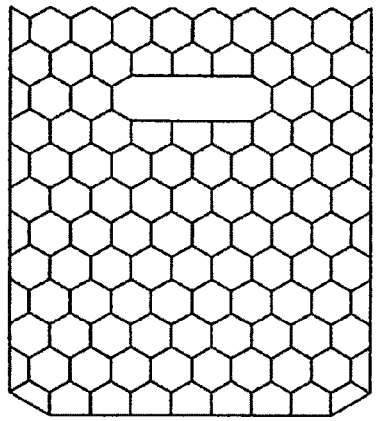

PIECE OF CLOTH AND CLOTH PRODUCT CONSISTING OF A LARGE NUMBER OF PIECES OF CLOTH

RELATED APPLICATIONS

The present application is National Phase of International Application No. PCT/JP2010/052232 filed Feb. 15, 2010, and claims priority from Japanese Applications No. 2009-037029, filed Feb. 19, 2009 and no. 2009-254507, filed Nov. 6, 2009, the disclosure of which is hereby incorporated by reference herein in its entirety.

TECHNICAL FIELD

This invention relates to a piece of cloth or a cloth piece that, when a number of flat small pieces are connected to each other, can constitute a variety of cloth products such as clothings, bags, shoes, curtains, window blinds, partitions, wall surface displays, rugs, lap robes, accessories, caps or hats, and tablecloths.

BACKGROUND ART

A number of products such as clothings comprising a number of flat small pieces connected to and combined with each other have hitherto been known.

For example, patent document 1 (Japanese Patent Application Laid-Open No. 125599/1986) discloses hexagonal small pieces of a blade proof sheet as a material for human body protecting clothes. Further, patent document 2 (Japanese Patent Application Laid-Open No. 343091/2006) discloses a blade-proof protecting member comprising a plurality of blade-proof sheets connected to each other and a blade-proof protecting cloth comprising a plurality of the blade-proof protecting members connected to each other. Furthermore, patent document 3 (Japanese Utility Model Application Laid-Open No. 117496/1985) discloses a composite protecting sheet that is composed mainly of a ceramic sheet and is suitable for bullet-proof vests and the like.

Furthermore, patent document 4 (U.S. Pat. No. 5,592,691) describes that a number of regular polygonal pieces of cloth are connected to each other with a slide fastener to constitute a cloth product.

PRIOR ART DOCUMENTS

Patent Documents

Patent document 1: Japanese Patent Application Laid-Open No. 125599/1986

Patent document 2: Japanese Patent Application Laid-Open No. 343091/2006

Patent document 3: Japanese Utility Model Application Laid-Open No. 117496/1985

Patent document 4: U.S. Pat. No. 5,592,691

SUMMARY OF THE INVENTION

Problems to be Solved by the Invention

As described above, conventional clothings comprising a number of flat small pieces connected to and combined with each other are those for human body protection purposes and are formed of small pieces of weighty and hard materials such as metals and ceramics or are formed of pieces of cloth connected to each other with a fastening means such as a fastener.

An object of the present invention is to provide pieces of cloth that, in the form of flat small pieces, can solely constitute clothings formed of lightweight and flexible materials and the above other products.

Means for Solving the Problems

According to the present invention, there is provided a piece of cloth comprising: a hexagonal central part; and first and second peripheral edge parts located alternately at the peripheral edges of the central part, wherein the first and second peripheral edge parts share respective one sides of the hexagon, the first peripheral edge parts each share two apexes of the hexagon, a first cut having a length shorter than the length of the side but longer than a quarter thereof is provided in the border line of the first peripheral edge part and the central part, a second cut having a length equal to or slightly longer than one half of [(the length of the side)−(the length of the first cut)] is provided on the border line of the second peripheral edge part and the central part from the opposite ends of the side, three first cuts in a first piece of cloth and second cuts in three other second different pieces of cloth having the same shape as the first piece of cloth can be positioned and fitted into each other for connection, and the three second cuts in the first piece of cloth and first cuts in three third pieces of cloth different from the three second pieces of cloth and having the same shape as the first piece of cloth can be positioned and fitted into each other for connection.

Preferably, the hexagon is symmetrical with respect to a point and is more preferably a regular hexagon.

Preferably, the length of connection width between the first peripheral edge part and one side of the hexagon and the length of connection width between the second peripheral edge part and one side of the hexagon are equal to the length of one side of the hexagon.

Preferably, the shape of the first peripheral edge part and the shape of the second peripheral edge part are any of rectangle, trapezium, semicircle, semiellipse, and triangle.

According to another aspect of the present invention, there is provided a cloth product comprising a number of the above pieces of cloth connected to each other in such a manner that the first cuts in pieces of cloth and the second cuts in other pieces of cloth are fitted into each other for the connection.

According to a further aspect of the present invention, there is provided a cloth product comprising a number of the above pieces of cloth connected to each other in such a manner that the second peripheral edge parts in the first piece of cloth are folded and are inserted into the first cuts in the first peripheral edge parts in the second pieces of cloth to fit the second cuts in the second peripheral edge parts in the first piece of cloth and the first cuts in the first peripheral edge parts in the second pieces of cloth to each other for the connection.

EFFECT OF THE INVENTION

The piece of cloth according to the present invention comprises a flat small piece and thus can realize a good material yield, and the piece of cloth can be prepared even from small materials without wastefulness. In addition, the piece of cloth according to the present invention is advantageous in that products having desired size and shape can be produced by connecting pieces of cloth having the same shape to each other. Accordingly, the piece of cloth according to the present invention can meet a demand for small lot multi kinds production and can advantageously realize high productivity.

In connecting pieces of cloth according to the present invention to each other, members usually necessary for the connection of this kind of flat small pieces and threads or other fastening means are not required, and, thus, anyone can easily prepare clothings and the above-described other products.

When the piece of cloth according to the present invention is used, a user himself or herself can enjoy the hand preparation of products, and, at the same time, a change in shape and color is possible according to the contemplated purposes. That is, in the piece of cloth according to the present invention, variations can be provided to the above products by varying the color and material of the piece of cloth, and the commercial value of the products can be improved.

Further, even when the product is damaged or broken, the user himself or herself can easily repair the product.

BRIEF DESCRIPTION OF THE DRAWINGS

FIG. 4(2) is a front view of another embodiment of the piece of cloth different from FIG. 4(1) according to the present invention.

FIG. 5(2) is a front view showing the state of a connected part of the piece of cloth shown in FIG. 4(2).

FIG. 6(2) is a rear view showing a state of connection of three pieces of cloth shown in FIG. 1.

FIG. 7 is a front view of each of a T-shirt and a bag that are formed of a number of pieces of cloth.

Figure 1:
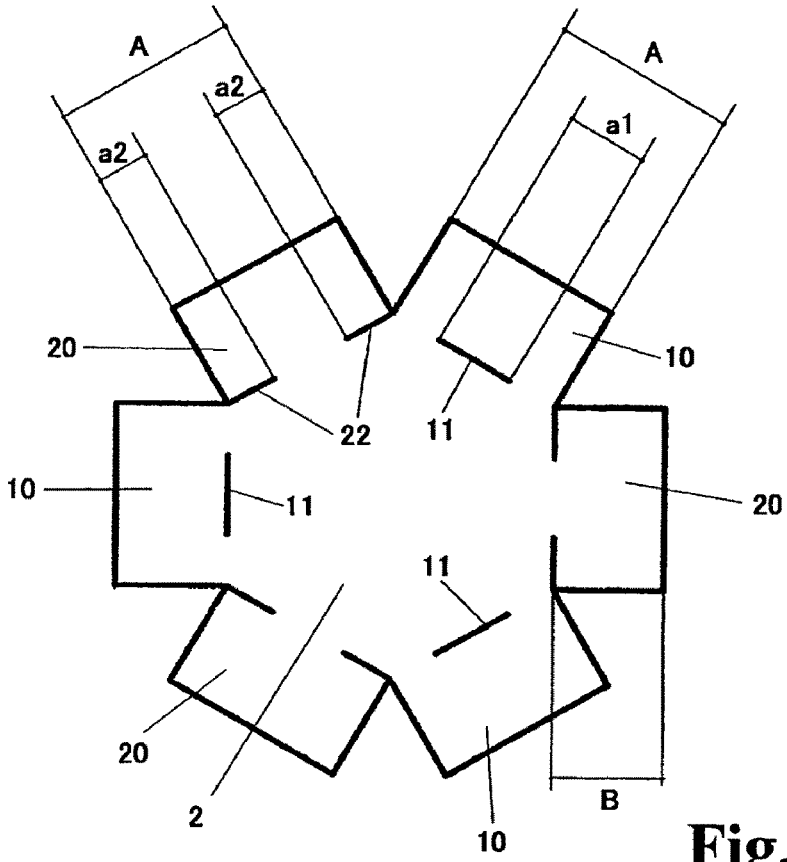
FIG. 1 is a front view of the piece of cloth according to the present invention.

| DESCRIPITON OF REFERENCE CHARACTERS | |
|---|---|
| 2 | central part |
| 10 | first peripheral edge part |
| 11 | first cut |
| 20 | second peripheral edge part |
| 22 | second cut |

MODE FOR CARRYING OUT THE INVENTION

Embodiments of the piece of cloth according to the present invention will be described with reference to the accompanying drawings.

FIG. 1 is a front view of a piece of cloth, and the piece of cloth comprises a regular hexagonal central part 2 and first peripheral edge parts 10, 10, 10 and second peripheral edge parts 20, 20, 20 that are located alternately at the peripheral edges of the central part 2.

Alternately arranging the first peripheral edge parts 10, 10, 10 and the second peripheral edge parts 20, 20, 20 can allow pieces of cloth to be planarly connected substantially infinitely.

The first peripheral edge part 10 and the second peripheral edge part 20 each share one side of the regular hexagonal central part 2 so that the first peripheral edge part 10 and the second peripheral edge part 20 are integrated with the central part 2.

A first cut 11 having a length shorter than a length of the shared side, i.e., A, but longer than a quarter thereof is provided in the border line of the first peripheral edge part 10 and the central part 2. In FIG. 1, the length of the first cut 11 is denoted by a1.

Second cuts 22, 22 having a length equal to or slightly longer than one half of [(the length of the side, A)−(the length of the first cut, a1)] is provided on the border line of the second peripheral edge part 20 and the central part 2 from the respective opposite ends of the side. Here the term "slightly longer" is used for excluding a length that cannot hold a connecting strength which will be described later. In FIG. 1, the length of the second cut 22 is denoted by a2.

As will be described later, the first cuts 11 in a first piece of cloth and the second cuts 22, 22 in second pieces of cloth are fitted into each other to connect pieces of cloth to each other. Accordingly, in order to hold the connecting strength between the pieces of cloth, the length of the first cut 11 and the length of the second cuts 22, 22 should be in the above-defined range. The length of the first cut 11, i.e. a1, is preferably one-fourth to three-fourth of the length of the shared side, particularly preferably approximately half of the length of the shared side.

The width of the first cut 11 and the width of the second cuts 22, 22 exclusively depend upon the thickness of the piece of cloth. The first (second) cut 11, 22 is passed through the piece of cloth from the front surface of the piece of cloth into the back surface of the piece of cloth.

The length of the first cut 11, i.e. a1, and the length of the second cuts 22, 22, i.e. a2, will be described in more detail. The length a1 and the length a2 vary depending upon the material, thickness and application of the piece of cloth. In preparing outer clothes using pieces of cloth that are made of polyester and have a thickness of about 0.1 mm, in FIG. 1, when the length of one side of the regular hexagon, i.e. A, is, for example, 25 mm, a1=11 mm and a2=7 mm.

The shape of the central part 2 is optimally a regular hexagonal shape. The regular hexagon can allow pieces of cloth to be connected to each other to constitute a plane without providing a space between the pieces of cloth, the pieces of cloth can be connected in any direction without limitation, and the regular hexagon is also excellent in connection strength.

Hexagons other than the regular hexagon are also preferred when the hexagons are symmetrical with respect to a point, because they can constitute a plane without subjecting to any restriction in the direction of connection and thus without providing a space between the pieces of cloth.

Figure 2:
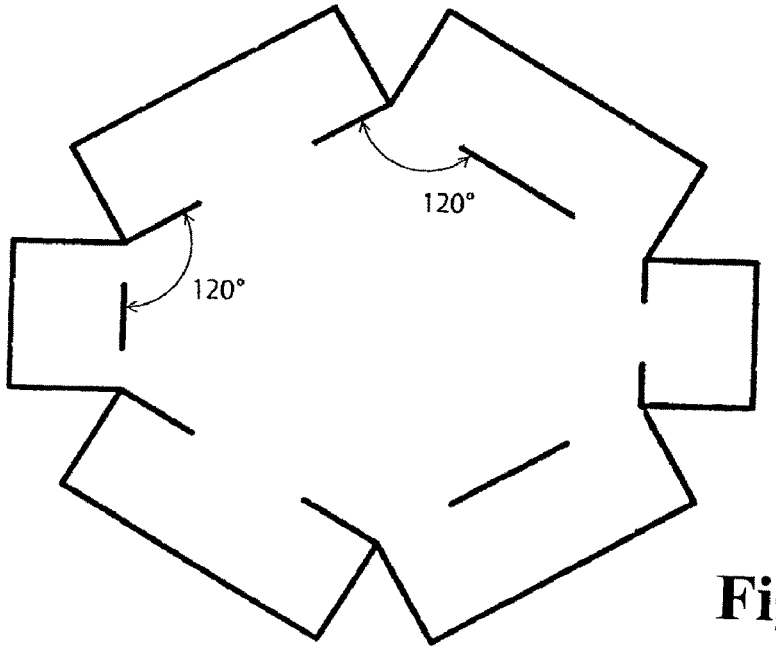
FIG. 2 is a front view of a variant of the piece of cloth according to the present invention.
Figure 3:
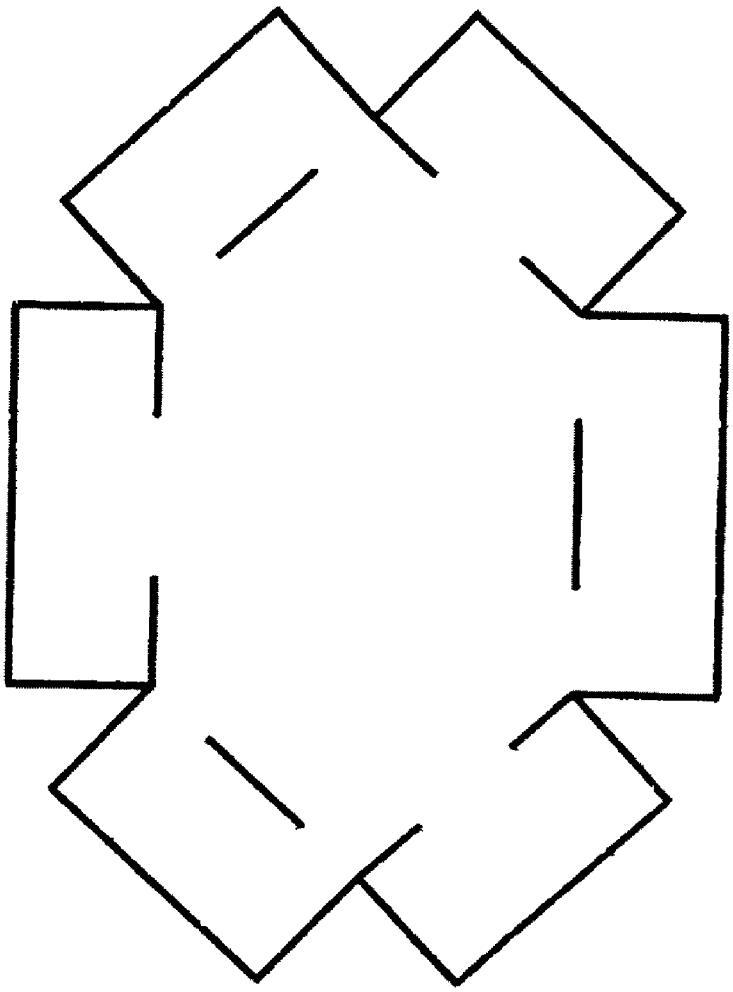
FIG. 3 is a front view of another variant of the piece of cloth according to the present invention.

Hexagons that are symmetrical with respect to a point include, for example, shapes formed by collapsing a regular hexagon in one direction (that is, hexagons that have six sides having the same length and having internal angles that are not 120 degrees but are of two kinds), hexagons, as shown in FIG. 2, all internal angles of which are 120 degrees and which have two kinds of length of sides, and hexagons, as shown in FIG. 3, that have two kinds of length of sides and two kinds of internal angles. For some applications of the products, it should be considered that, in the above hexagons, a shorter connected side has a lower connection strength than a longer connected side.

When the central part 2 has a hexagonal shape that is other than the regular hexagon and the hexagon symmetrical with respect to a point and, regarding a line segment connecting a pair of opposed angles to each other, is symmetrical with respect to a line, disadvantageously, there are many restrictions in the direction of the connection although a plane not having a space can be formed.

Further, in the central part 2, square, rectangular or rhombic shapes are also not preferred, because, in some cases, pieces of cloth cannot be connected to form a ring shape or superposition of the first peripheral edge part 10 or the second peripheral edge part 20 or the production of cockles occurs.

The size of the piece of cloth probably varies depending upon the properties and size of products constituted by pieces of cloth but is not particularly limited. Since, however, the pieces of cloth according to the present invention are basically connected to each other by hand work, for example, when the central part has a regular hexagonal shape, the length of one side of the regular hexagon is preferably in the range of 10 to 900 mm.

The shape of the first peripheral edge part 10 and the shape of the second peripheral edge part 20 are not particularly limited. In general, however, these shapes are determined by taking into consideration conditions for the production of pieces of cloth such as easiness of production, as well as design as first (second) peripheral edge part 10, 20. This is because the shape of the first (second) peripheral edge part 10, 20 determines design of the back surface (optionally the front surface) of products formed of pieces of cloth. It should be noted that, in the preparation of clothing using the piece of cloth, the back surface of the piece of cloth is largely involved in functions of the clothing, for example, heat retaining properties/moisture retaining properties and texture and, thus, the material and thickness of the piece of cloth in addition to the shape of the piece of cloth should be determined depending upon applications to which the piece of cloth is applied.

In general, the shape of the first (second) peripheral edge part 10, 20 may be rectangle, trapezium, semicircle, semiellipse, or triangle.

The length of the connection width which serves as the border line of the first peripheral edge part 10 or the second peripheral edge part 20 and the central part 2 is equal to a length A of the side of the hexagon. When the connection width is shorter than the length A of the side of the hexagon, the connection strength between pieces of cloth is sometimes lowered although the connection strength varies depending upon the material for the piece of cloth. On the other hand, when the connection width is longer than the length A of the side of the hexagon, it is difficult to obtain from a piece of textile.

The connection length of the first peripheral edge part 10 and the connection length of the second peripheral edge part 20 (that is, the length of connection in a direction vertical to the length of connection width) are not particularly limited but should be such that, when one piece of cloth is pulled, the piece of cloth is not easily separated from another piece of cloth connected to the piece of cloth. For example, when the length of one side of the regular hexagon shown in FIG. 1, i.e. length A, is 25 mm, the connection length B is 15 mm. Further, the connection length may be not less than 25 mm when an importance is placed on the design of pieces of cloth and cloth products.

Figure 4:
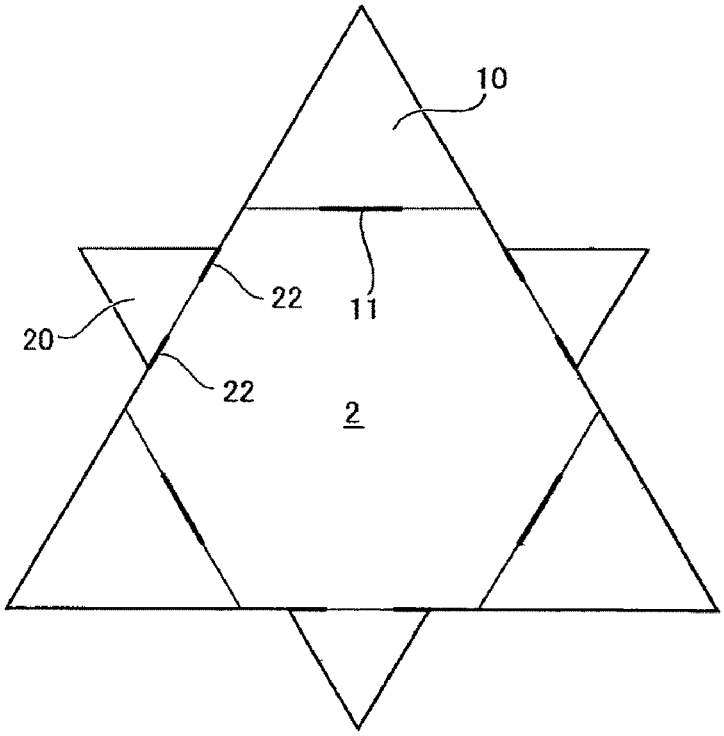
FIG. 4(1) is a front view of another embodiment of the piece of cloth according to the present invention.
Figure 4:
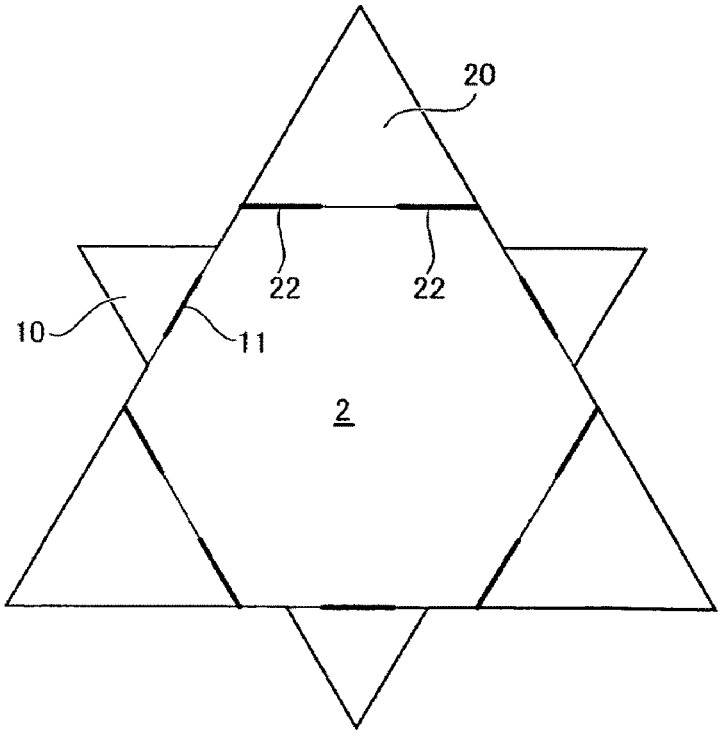

FIG. 4 shows embodiments of a piece of cloth in which both a first peripheral edge part 10 and a second peripheral edge part 20 have a regular triangle shape. The triangle shape is advantageous in that pieces of cloth can easily be connected to each other and, at the same time, a thin cloth product can easily be prepared because the first peripheral edge part 10 and the second peripheral edge part 20 do not overlap with each other.

FIG. 4(1) shows a piece of cloth in which the length of the connection width in the first peripheral edge part 10 is equal to the length of the side of the regular hexagonal central part 2 while the length of the connection width in the second peripheral edge part 20 is less than the length of the side of the regular hexagonal central part 2. Specifically, the first peripheral edge part in the piece of cloth shown in FIG. 4(1) shares two apexes of the regular hexagon, whereas the second peripheral edge part does not share two apexes of the regular hexagon.

On the other hand, FIG. 4(2) shows a piece of cloth in which the length of the connection width in the second peripheral edge part 20 is equal to the length of the side of the regular hexagonal central part 2 while the length of the connection width in the first peripheral edge part 10 is less than the length of the side of the regular hexagonal central part 2. Specifically, the second peripheral edge part in the piece of cloth shown in FIG. 4(2) does not share two apexes of the regular hexagon due to the presence of second cuts 22, 22, and the first peripheral edge part as well does not share two apexes of the regular hexagon.

Figure 5:
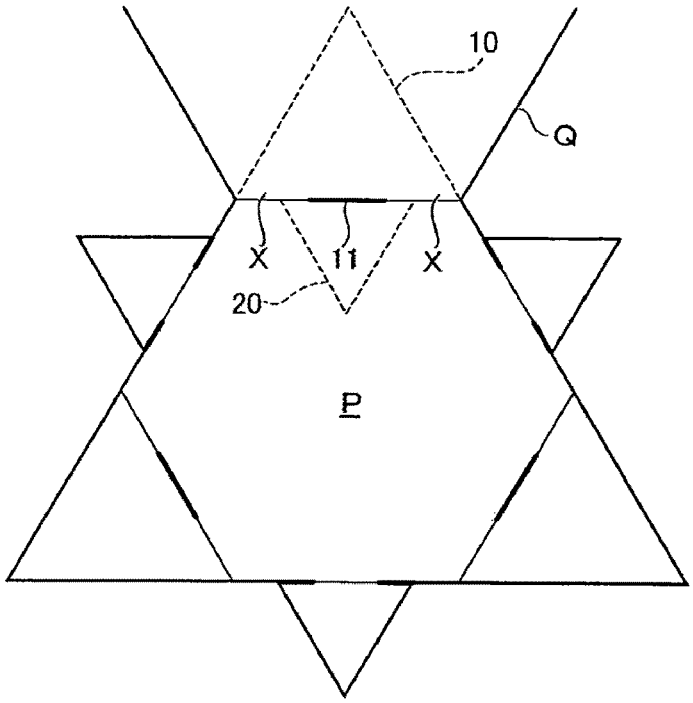
FIG. 5(1) is a front view showing the state of a connected part of the piece of cloth shown in FIG. 4(1).
Figure 5:
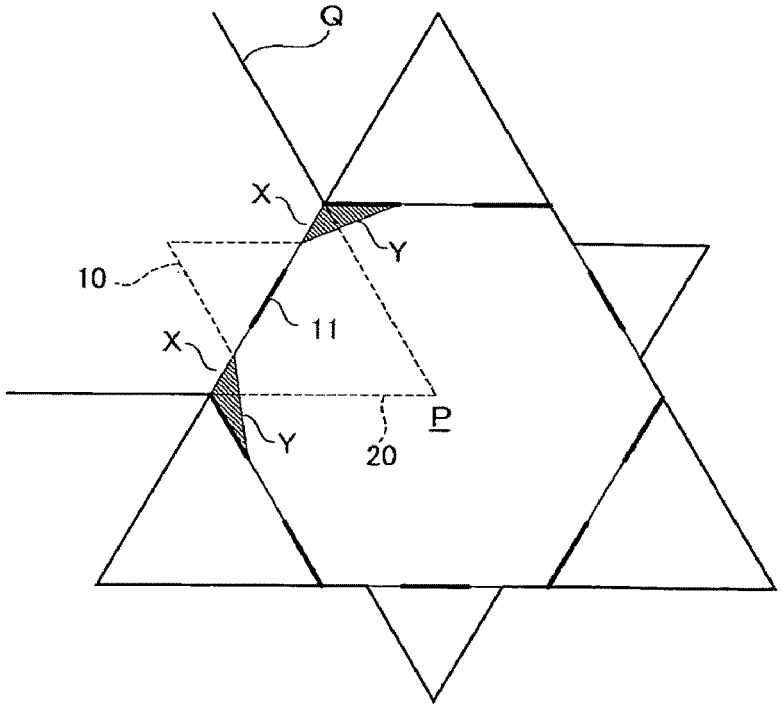

A state of connection of the piece of cloth shown in FIG. 4 will be then described with reference to FIG. 5. FIG. 5(1) shows a state of connection of two pieces of cloth shown in FIG. 4(1), and FIG. 5(2) shows a state of connection of two pieces of cloth shown in FIG. 4(2).

At the outset, in FIG. 5(2), second cuts 22, 22 in a second peripheral edge part 20 in a second cloth piece (a second piece of cloth) Q are fitted into a first cut 11 in a first peripheral edge part 10 in a first cloth piece (a first piece of cloth) P. In this state, the first peripheral edge part 10 in the first cloth piece P is located on the back surface of the central part 2 in the second cloth piece Q, and the second peripheral edge part 20 in the second cloth piece Q is located on the back surface of the central part 2 in the first cloth piece P.

In this case, the first peripheral edge part 10 in the first cloth piece P does not share two apexes of the regular hexagonal central part 2, that is, parts indicated by reference characters X, X are deficient. Accordingly, the parts X, X are not pressed by the central part 2 in the second cloth piece Q. Consequently, corner parts Y, Y (indicated in gray color) are likely to be lifted. The lifted corner parts Y, Y are likely to be caught on a body or an object in contact with the corner parts Y, Y, and this is causative of damage to the piece of cloth.

By contrast, in FIG. 5(1), the positional relationship between the first peripheral edge part 10 in the first cloth piece P and the second peripheral edge part 20 in the second cloth piece Q is quite the same as the positional relationship in FIG. 5(2). Since, however, the first peripheral edge part 10 in the first cloth piece P shares two apexes of the regular-hexagonal central part 2, that is, parts indicated by reference characters X, X are pressed from the front side by the central part 2 in the second cloth piece Q. Consequently, there is no possibility that the corner parts of the central part 2 in the first cloth piece P is lifted. This effect is more significant when the material is more flexible.

The thickness of the cloth piece is determined by the material for the cloth piece and product to be applied. It is generally considered that, when the connection can be more easily made, the strength is lower. In this case, however, pieces of cloth can easily be separated from each other, and, thus, this point should be taken into consideration. In general, the thickness of the piece of cloth is preferably not more than 5 mm, more preferably approximately 0.1 to 3 mm.

A sheet-shaped material having flexibility high enough to bend suffices as the material for the piece of cloth in the present invention, and examples of such materials include various woven fabrics, non-woven fabrics, laces, felts and the like of natural fibers or synthetic fibers of nylons, polyesters and the like, synthetic resins, synthetic rubbers and the like. For example, leathers and suedes are also possible.

Among them, for example, non-woven fabrics, felts, leathers, and suedes are advantageous in that, after cutting of the material sheet, the ends do not come apart and cutting by a laser cutter or embossing can easily be carried out.

Figure 6:
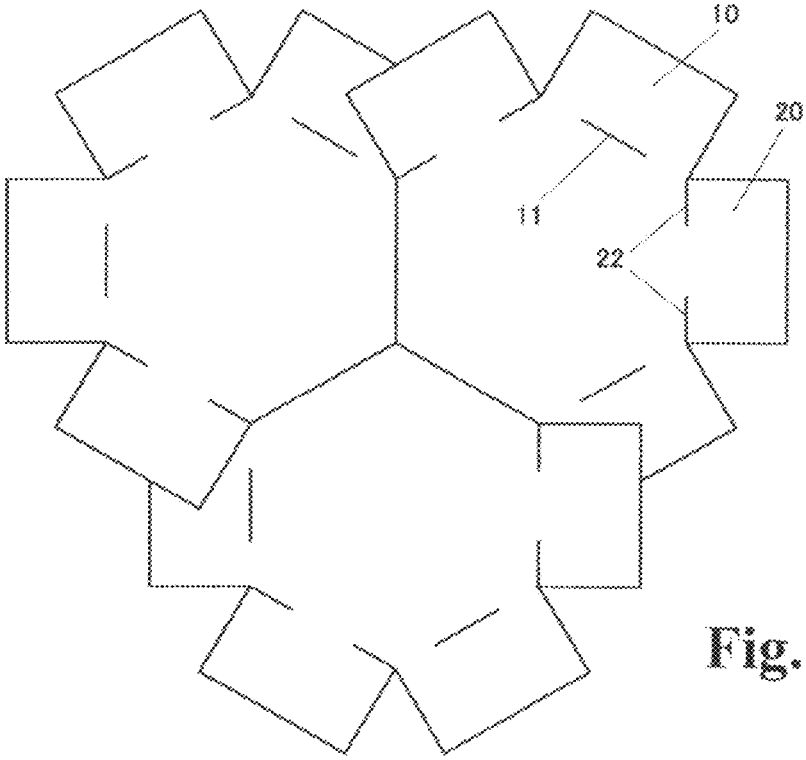
FIG. 6(1) is a front view showing a state of connection of three pieces of cloth shown in FIG. 1.
Figure 6:
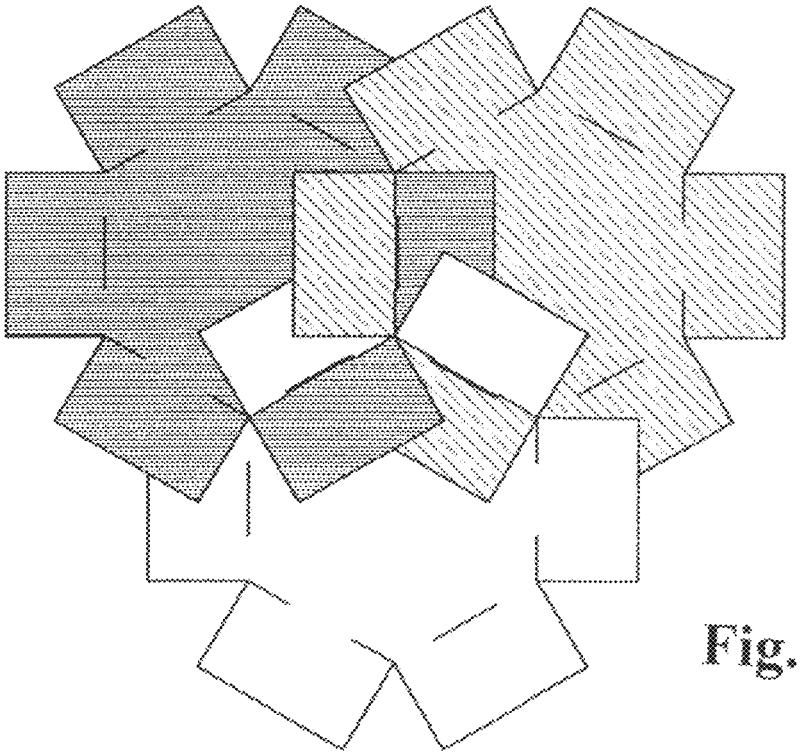

Various cloth products can be prepared from the above-described pieces of cloth by fitting the first cut 11 in the first peripheral edge part 10 and the second cuts 22, 22 in the second peripheral edge part 20 in another pieces of cloth into each other to plarnarly connect a number of pieces of cloth to each other. FIG. 6 shows a state of connection of three pieces of cloth as shown in FIG. 1. Each first cut 11 (and second cuts 22, 22) in a first piece of cloth and second cuts 22, 22 (and first cut 11) in second pieces of cloth having the same shape as the first piece of cloth are connected to each other by rendering the first cuts 11, in the first piece of cloth, coincident with the second cuts 22, 22 in the second piece of cloth and fitting the cuts into each other. FIG. 6(1) is a front view, and FIG. 6(2) is a rear view.

More specifically, various cloth products can be prepared by planarly connecting a number of pieces of cloth to each other in such a manner that the second cuts 22, 22 in the second peripheral part 20 in a first piece of cloth are folded and are inserted into the first cuts 11 in the first peripheral part 10 in a second piece of cloth to fit the first cuts 11 and the second cuts 22, 22 into each other. FIG. 7 is a front view of each of a T-shirt and a bag formed of a number of pieces of cloth.

The invention claimed is:

1. A piece of cloth comprising: a hexagonal central part; and first and second peripheral edge parts located alternately at peripheral edges of the central part, wherein the first and second peripheral edge parts share respective one sides of the central part, the first peripheral edge parts each share two apexes of the central part, a first cut having a length shorter than a length of the side but longer than a quarter thereof is provided in a border line of the first peripheral edge part and the central part, a second cut having a length equal to or slightly longer than one half of a difference in the length between the side and the first cut is provided on a border line of the second peripheral edge part and the central part from opposite ends of the side, three first cuts in a first piece of cloth and second cuts in three second pieces of cloth having a same shape as the first piece of cloth can be positioned and fitted into each other for connection, and the three second cuts in the first piece of cloth and first cuts in three third pieces of cloth different from the three second pieces of cloth and having the same shape as the first piece of cloth can be positioned and fitted into each other for connection.

2. The piece of cloth according to claim 1, wherein the central part is symmetrical with respect to a point.

3. The piece of cloth according to claim 1, wherein the central part is a regular hexagon.

4. The piece of cloth according to claim 1, wherein the length of connection width between the first peripheral edge part and one side of the central part and the length of connection width between the second peripheral edge part and one side of the central part are equal to the length of one side of the central part.

5. The piece of cloth according to claim 1, wherein a shape of the first peripheral edge part and a shape of the second peripheral edge part are any of rectangle, trapezium, semicircle, semiellipse, and triangle.

6. A cloth product comprising a number of the pieces of cloth according to claim 1 connected to each other in such a manner that the first cuts in the pieces of cloth according to claim 1 and the second cuts in other pieces of cloth according to claim 1 are fitted into each other for the connection.

7. A cloth product comprising a number of the pieces of cloth according to claim 1 connected to each other in such a manner that the second peripheral edge parts in the first piece of cloth according to claim 1 are folded and are inserted into the first cuts in the first peripheral edge parts in the second pieces of cloth to fit the second cuts in the second peripheral edge parts in the first piece of cloth and the first cuts in the first peripheral edge parts in the second pieces of cloth to each other for the connection.

* * * * *